US007216442B2

(12) United States Patent
Cheng

(10) Patent No.: US 7,216,442 B2
(45) Date of Patent: May 15, 2007

(54) DRYING DEVICE FOR A WOOD-WASTE COLLECTING MACHINE

(75) Inventor: Chieh-Yuan Cheng, Taichung (TW)

(73) Assignee: San Ford Machinery Co., Ltd., Taichung (TW)

( * ) Notice: Subject to any disclaimer, the term of this patent is extended or adjusted under 35 U.S.C. 154(b) by 149 days.

(21) Appl. No.: 11/150,130

(22) Filed: Jun. 13, 2005

(65) Prior Publication Data

US 2006/0277784 A1 Dec. 14, 2006

(51) Int. Cl.
*F26B 19/00* (2006.01)

(52) U.S. Cl. ..... 34/198; 34/202

(58) Field of Classification Search ..... 34/397, 34/198, 77, 202; 144/271, 2.1
See application file for complete search history.

(56) References Cited

U.S. PATENT DOCUMENTS 2,222,633 A * 11/1940 Sheesley ..... 425/82.1
3,926,582 A * 12/1975 Powell et al. ..... 48/62 R
5,280,757 A * 1/1994 Carter et al. ..... 110/346
6,675,495 B2 * 1/2004 Dedieu et al. ..... 34/245

* cited by examiner

*Primary Examiner*—S. Gravini
(74) *Attorney, Agent, or Firm*—Troxell Law Office, PLLC

(57) ABSTRACT

A drying device for a wood-waste collecting machine includes a blower set on the base of the machine and a heating member connected between the blower and the conveying device of the machine. The blower has an air outlet connected with a windpipe, and the heating member is connected with one end of the windpipe, having a tubular member and a heating element in the tubular member. Between the other end of the heating member and a preset sidewall of the container of the conveying device is provided a pipe joint, for air sucked by the blower blown in the heating member to heat. Then heated air is blown through the air holes of the sidewall of the collecting chamber of the container of the conveying device to dry wood waste therein and then compressed in the compressing device of the machine to become tight solid blocks.

3 Claims, 5 Drawing Sheets

DRYING DEVICE FOR A WOOD-WASTE COLLECTING MACHINE

BACKGROUND OF THE INVENTION

1. Field of the Invention

This invention relates to a drying device for a wood-waste collecting machine, particularly to one for drying moisture of wood waste with heat so as to let wood waste possible to be compressed into a tight block uneasily to loosen off.

2. Description of the Prior Art

Wood processing machines produce a large volume of wood waste, which is normally very light and bulky, and liable to fly and float around in the air, affecting air quality and humane health. When it is packed in a bag or the like, it takes much space, and in addition, it is very flammable and easily catches fire to cause danger to life and property.

Therefore, a wood-waste collecting machine has been made for collecting wood waste in a waste tank, and a snapping device provided in the waste tank for pushing it to fall in a conveying device and then is sent into a compressing device, which then compresses it into wood-waste blocks by means of compressing rods, in order to improve the above-mentioned problems.

However, wood waste has many tiny holes to suck therein moisture in the air to become very wet. So the moisture of wood waste prevents the wood-waste blocks from being tight and solid because of the moisture therein, Then wood waste blocks formed are apt to give rise to cracks in case of mutual collision, and even completely collapses into pieces if worse. Thus its compressing effect is quite bad.

SUMMARY OF THE INVENTION

A drying device for a wood-waste collecting machine in the invention includes a blower set on the base of the machine and a heating member. The blower has an outlet hole connected with one end of a windpipe, and the heating member is connected with the other end of the windpipe, having a heating element and a passage. A pipe joint is connected between the other end of the heating device and a sidewall of the container of the conveying device. Then the blower blows outer air sucked in into the heating member for heating the air and blown into the collecting chamber through the sidewall of the container of the conveying device. Then wood waste in the collecting chamber is dried, and the dried wood waste is sent into the compressing device of the machine to be compressed to become tight and solid blocks uneasy to loosen or crack.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
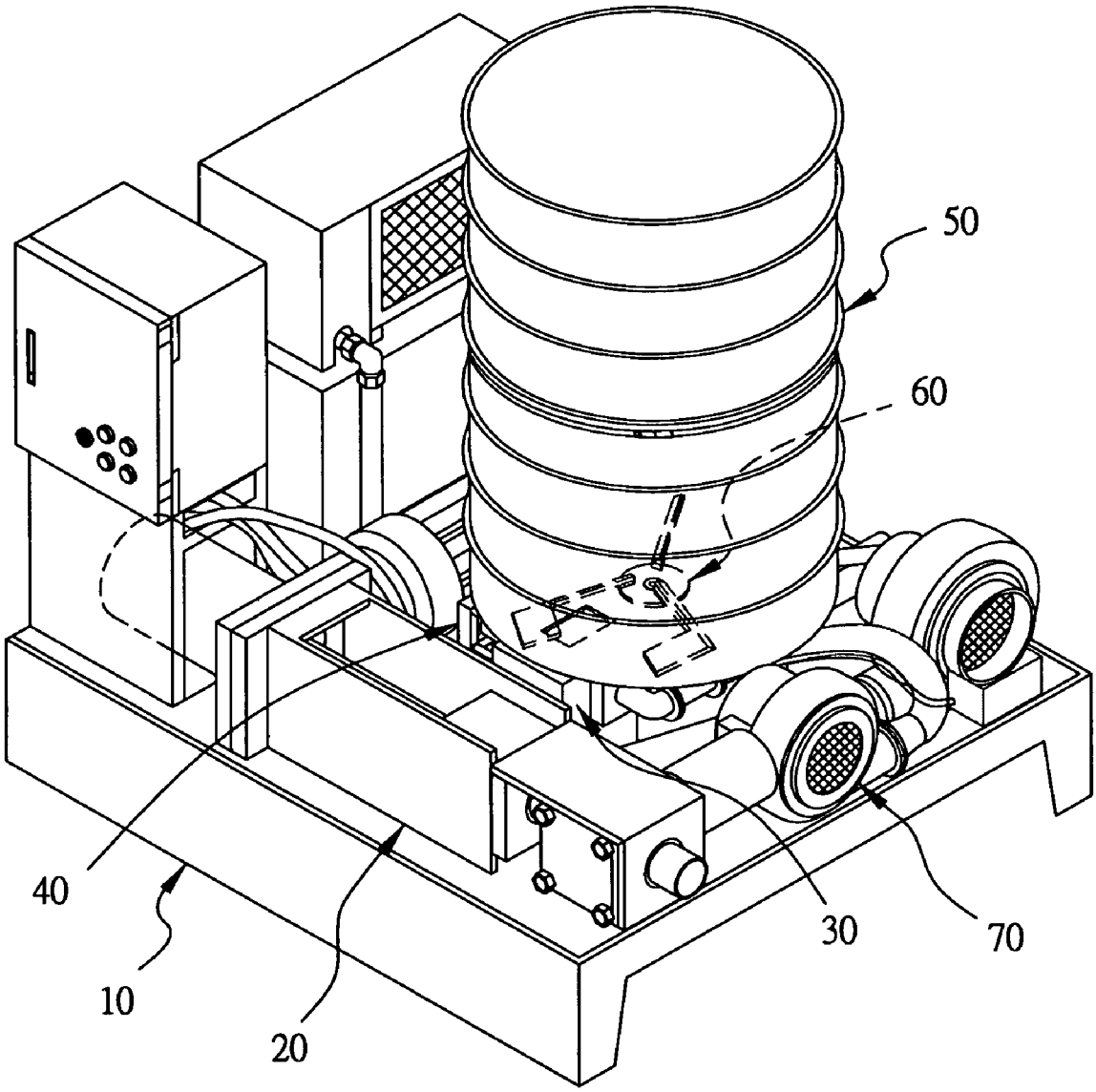
FIG. 1 is a perspective view of a wood-waste collecting machine provided with a drying device in the present invention.
Figure 2:
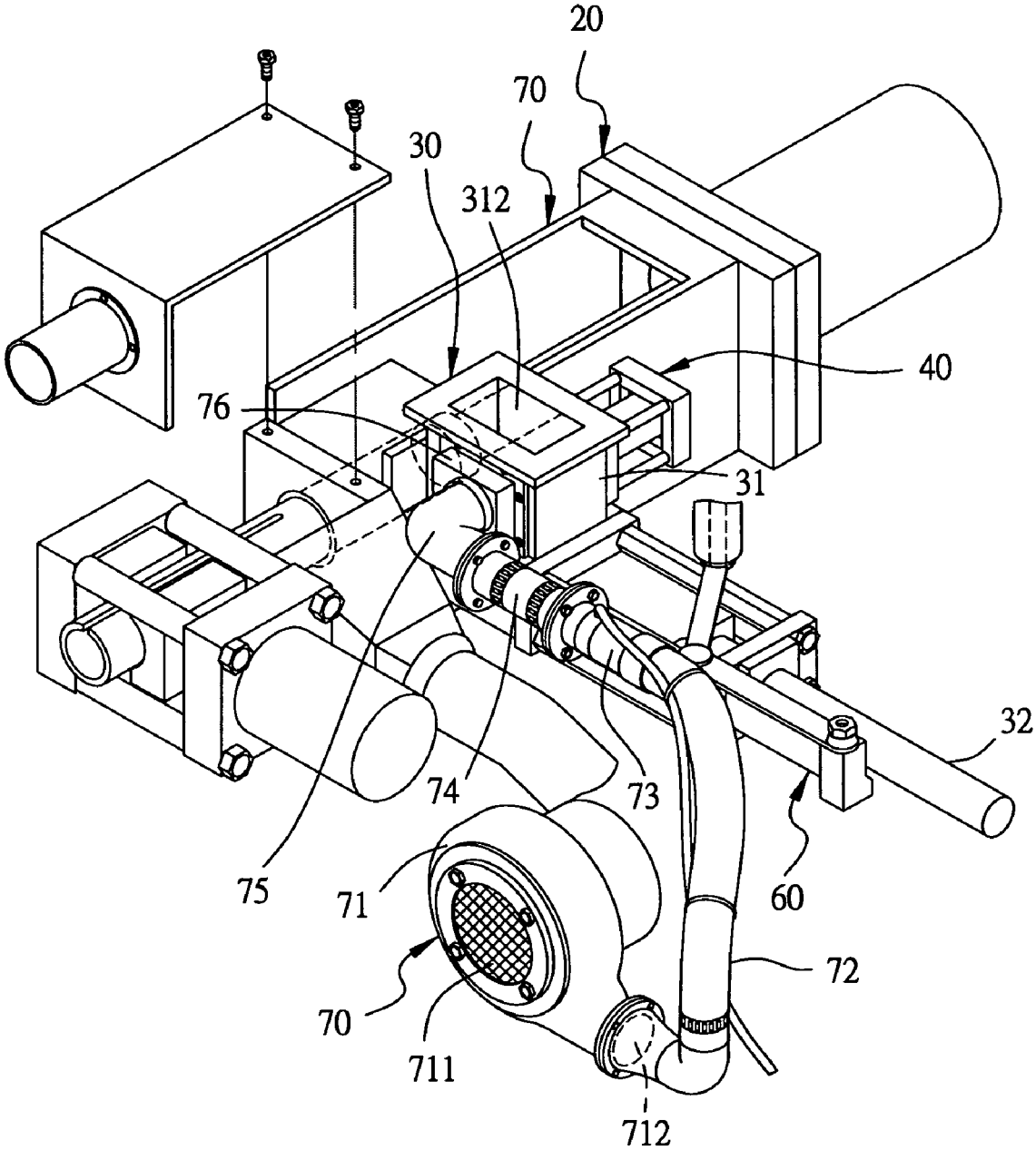
FIG. 2 is a partial cross-sectional and perspective view of the wood-waste collecting machine with the drying device in the present invention.
Figure 3:
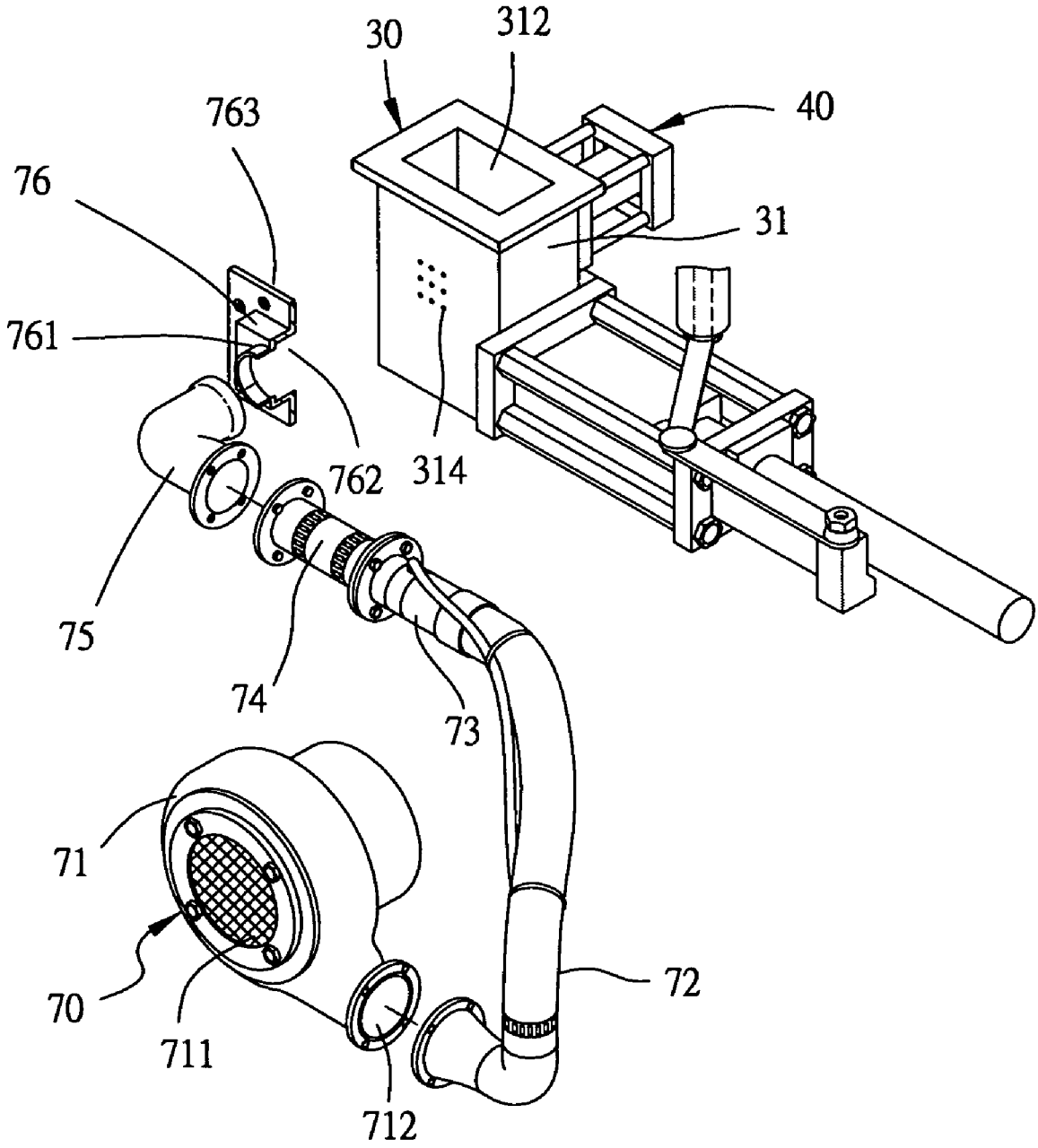
FIG. 3 is an exploded perspective view of the drying device in the present invention.

A preferred embodiment of a drying device 70 for a wood-waste collecting machine in the present invention, as shown in FIGS. 1, 2, and 3, is set in a wood-waste collecting machine, which includes a base 10, a compressing device 20, a conveying device 30, a cutting device 40, a waste tank 50, and a snapping device 60 as main components.

The compressing device 20 is set on the base 10, for compressing wood waste into blocks.

The conveying device 30 is set at one side of the compressing device 20 on the base 10, consisting of a container 31 formed with an inner collecting chamber 311 provided with an upper falling hole 312, and a material feeding hole 313 formed in a sidewall of the container 31 and communicating with the compressing device 20, with a conveying rod 32 pushing wood waste in the collecting chamber 311 into the compressing device 20.

The cutting device 40 is fixed at the inner side of the container 31 for cutting wood waste falling in the collecting chamber 311.

The waste tank 50 is installed on the conveying device 30 for storing wood waste therein.

The snapping device 60 is arranged in an inner lower portion of the waste tank 50 for breaking off tangled-together wood waste to let it easily falling down through the falling hole 312 into the collecting chamber 311.

The container 31 of the conveying device 30 has plural air inlets 314 formed in an outer sidewall to communicate with the collecting chamber 311.

Figure 4:
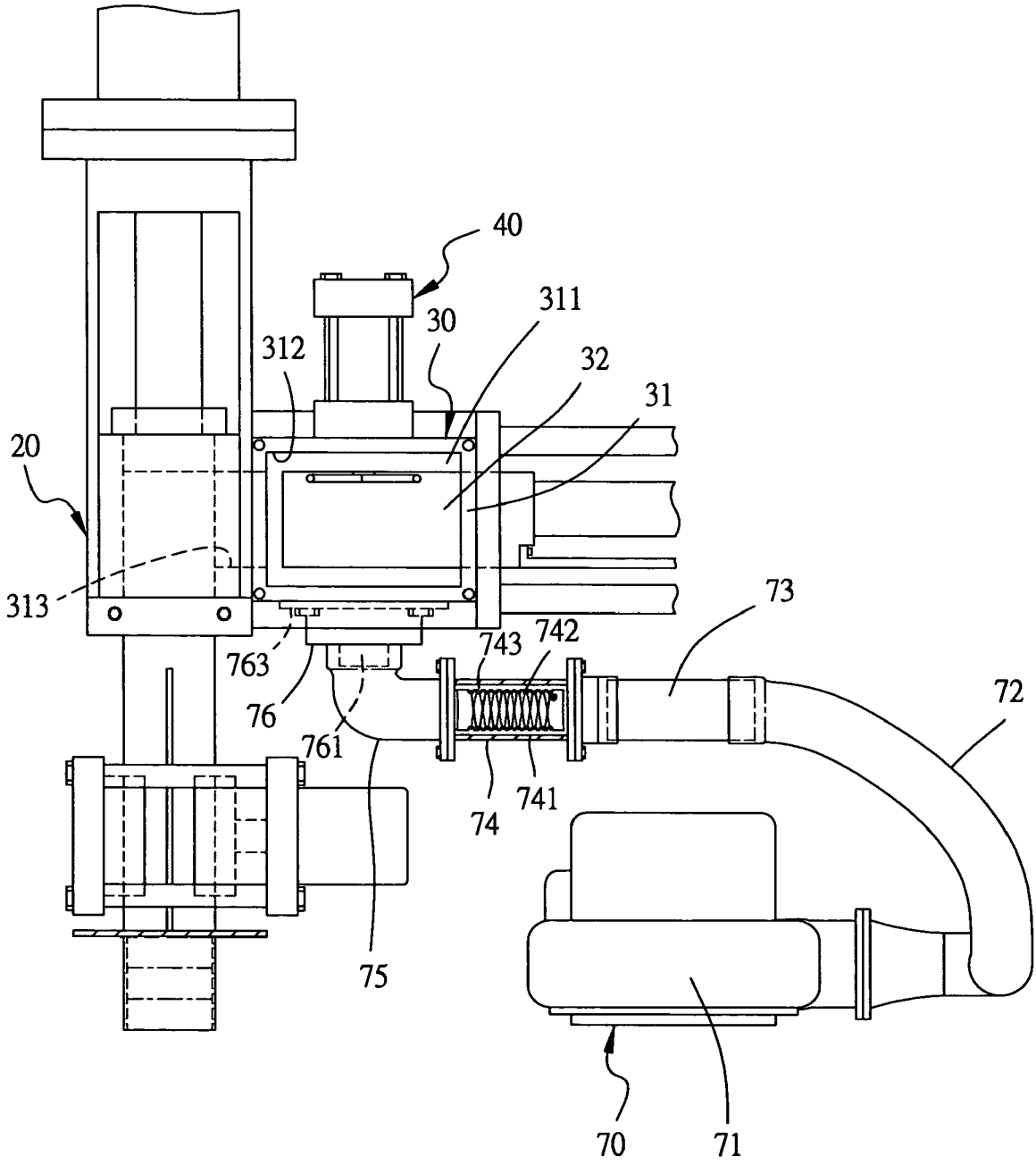
FIG. 4 is an upper partial cross-sectional view of the drying device in the present invention; and, FIG. 5 is a cross-sectional view of the drying device under a wind-blowing condition in the present invention.
Figure 5:
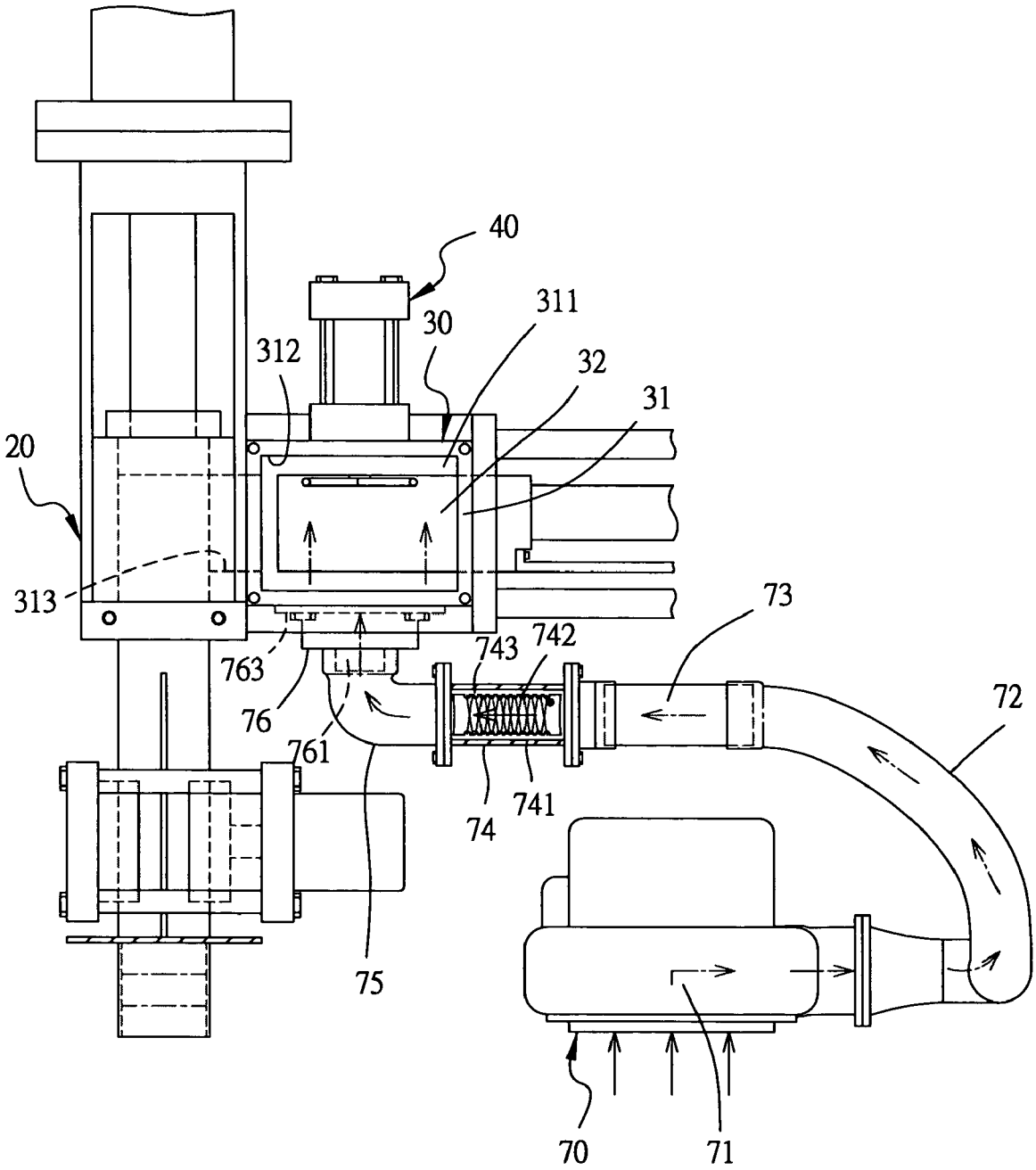

The drying device 70, as shown in FIG. 4, consists of a blower 71 and a heating member 74. The blower 71 is set properly on the base 10 and having a sucking hole 711 for sucking in outer air and an outlet hole 712 connected with a plastic windpipe 72. Further, a connect pipe 73 is connected with an end of the windpipe 72 at one end, and further connected with a heating member 74 at the other en. The heating member 74 consists of a metal tubular member 741 and a heating element 742 positioned in the tubular member 741. The heating element 742 is composed of a ceramic insulating rod wound with an electric heating wire. When the electric heating wire is powered, it gives out heat. Further, between the metal tubular member 741 and the heating element 742 is provided a passage 743 for wind coming from the blower 71 to pass therethrough, and the heating member 74 has the other end connected with a pipe joint 75, with a cap 76 fixed between the pipe joint 75 and the sidewall of he container 31 where the inlet hole 314 is provided. Then the cap 76 has a pipe connecting hole 761 for the other end of the pipe joint 75 to fit stably therein and a mouth 762 in the outer side of he connecting hole 761, and a wall 763 extending around the mouth 762 and to be fixed firmly with the sidewall of the container 31.

Next, in using the drying device 70, it is started to let the blower 71 suck outer air through the sucking hole 711 into the wind pipe 72, the connect pipe 73, the passage 743 of the heating member 74, the pipe joint 75, the cap 76 and then through the air inlets 314 and finally in the collecting chamber 311 of the container 31 of the conveying device 30. Meanwhile the heating element 742 located in the passage 743 of the heating member 74 is electrified to give rise to heat, which then heats up the air passing through the passage 743, and the heated air may be blown into the collecting chamber 311 to dry the wood waste stored therein.

To mention particularly, it will take about ten seconds for wood waste to fall from the waste tank 50 into the collecting chamber 311 and cut by the cutting device 40 and then into the compressing device 20, and these ten seconds may be enough for the wood waste in the collecting chamber 311 to dry for a substantial degree. Therefore, the dried wood waste is compressed into blocks, which may be comparatively tight and solid with only little moisture remained therein, uneasily loosening off or cracking or breaking off even collided with some exterior object, While the preferred embodiment of the invention has been described above, it will be recognized and understood that various modifications may be made therein and the appended to cover all such modifications that may fall within the spirit and scope of the invention.

What is claimed is:

1. A drying device for a wood-waste collecting machine, said wood-waste collecting machine comprising a base, a compressing device set on the base for compressing wood waste into waste blocks, a conveying device set at one side of said compressing device and having a container, said container provided with a collecting chamber and a fall hole formed on top of said collecting chamber and a feeding hole formed in a sidewall to communicate with said compressing device, a waste tank fixed on said conveying device for storing wood waste therein, wood waste falling from the bottom of said waste tank and through said falling hole of said conveying device into said collecting chamber; and characterized by, Said container of said conveying device provided with plural air holes in a preset sidewall communicating with said collecting chamber;

said drying device consisting of a blower and a heating member, said blower fixed on a preset location on said base and having an air outlet connected with a wind pipe, said heating member consisting of a tubular member and a heating element fixed in said tubular member for electrified to give out heat, said heat member having one end connected with an end of said wind pipe and other end connected with one end of a pipe joint, said tubular member having a passage formed between said heating element for wind to pass through so that wind may be heated in said passage, said pipe joint having the other end connected with the sidewall of said container for the heated wind to blow through said air holes in said sidewall into said collecting chamber of said container of said conveying device so that wood waste in said collecting chamber may be dried, said dried wood waste conveyed into said compressing device for compressing said dried wood waste into blocks, which may be tight and solid with little moisture and uneasily loosen to become bulky.

2. The drying device for a wood-waste collecting machine as claimed in claim 1, wherein said conveying device consists of a plastic soft pipe and a metal connect pipe, and said metal connect pipe is connected between said plastic soft tube and said heating member.

3. The drying device for a wood-waste collecting machine as claimed in claim 1, wherein said pipe joint is made of metal, and a cap is further provided between said pipe joint and said conveying device, said cap provided with a pipe connecting hole for one end of said pipe joint to fit tightly therein and a mouth formed in the outer side, and a wall formed around said mouth to fix with said sidewall of said container of said conveying device.

* * * * *